US008203065B2

(12) United States Patent
Yoshino

(10) Patent No.: US 8,203,065 B2
(45) Date of Patent: Jun. 19, 2012

(54) PERCUSSION INSTRUMENT

(75) Inventor: Kiyoshi Yoshino, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 13/151,211

(22) Filed: Jun. 1, 2011

(65) Prior Publication Data

US 2012/0000346 A1 Jan. 5, 2012

(30) Foreign Application Priority Data

Jul. 2, 2010 (JP) ..... 2010-152508

(51) Int. Cl.
*G10D 13/02* (2006.01)

(52) U.S. Cl. ..... 84/422.1

(58) Field of Classification Search ..... 84/421, 84/422.1, 422.2, 422.3
See application file for complete search history.

(56) References Cited

U.S. PATENT DOCUMENTS 4,817,485 A 4/1989 Bozzio et al.
7,795,520 B1 * 9/2010 Chen ..... 84/422.1
2005/0120862 A1 6/2005 Frazier

FOREIGN PATENT DOCUMENTS

DE 44 01 545 A1 5/1995
EP 0 651 370 A1 4/1998
JP 07-225581 A 8/1995
JP H11-212566 8/1999

* cited by examiner

*Primary Examiner* — Kimberly Lockett

(74) *Attorney, Agent, or Firm* — Foley & Lardner LLP

(57) ABSTRACT

A percussion instrument is configured for minimizing space used for set up for use. The percussion instrument uses a belt member stretched between one of two upper stretching members and a lower stretching member, to form a striking surface. By using the elasticity of the belt member, the striking surface can simulate the tension sensation of a conventional acoustic percussion instrument. By forming the belt member in a band shape, the width dimensions of the striking surface can be small relative to conventional circular shaped striking surfaces.

21 Claims, 5 Drawing Sheets

PERCUSSION INSTRUMENT

CROSS-REFERENCE TO RELATED PATENT APPLICATIONS

Japan Priority Application 2010-152508, filed Jul. 2, 2010 including the specification, drawings, claims and abstract, is incorporated herein by reference in its entirety.

FIELD OF THE INVENTION

The present invention relates to a percussion instrument and, in particular embodiments, to a percussion instrument that utilizes a relatively small space for setup.

BACKGROUND

An example of a percussion instruments that simulates an acoustic bass drum is disclosed in Japanese Laid-Open Patent Application Publication (Kokai) Number H11-212566. The instrument described in that patent reference has a head 3 that is configured from a net form material arranged over an opening end of a cylindrical shell 1. As a result, the acoustic striking sound when the head 3 is struck is suppressed, while vibrations of the head 3 are detected by the striking sensor 4. In the above-described percussion instrument, the shell 1 is formed roughly in a cylindrical shape and the head 3 is configured in a circular shape. Because of this, the height and right-to-left width dimensions of the instrument, when viewed from the front, can be relatively large. As a result, the overall size of the percussion instrument can be relatively large and, thus, can require a relatively large set-up space.

SUMMARY OF THE DISCLOSURE

According to embodiments of the present invention, a percussion instrument can be configured to utilize a relatively small set-up space.

In a percussion instrument according to an example embodiment of the present invention, a belt member is made to vibrate upon being struck on a striking surface of the belt member. In this embodiment, the belt member is formed in a band shape from an elastic material and is stretched between stretching members that are supported on a frame. The belt member has a tensile force that manifests a sinking and rebounding action of the striking surface, upon the belt member being struck. Therefore, the same tension sensation as that of an acoustic percussion instrument is reproduced and simulated. In addition, the dimensions of the striking surface in the width direction may be made relatively small, as compared to the case in which the striking surface is configured in a circular shape. Accordingly, the overall size of the percussion instrument can be reduced or minimized, thus, making it possible to utilize a reduced or minimized space to set up the percussion instrument for use. In addition, because the striking surface can be made relatively small, the striking sound generated upon striking the striking surface can be made relatively small, as compared to the case in which the striking surface is configured in a circular shape.

In a further example of a percussion instrument according to the above embodiment of the present invention, at least one of the two stretching members is supported on the frame in a manner that allows adjustable movement relative to the other stretching member. In particular, one or both of the stretching members may be adjustably moved in the long direction of the belt member with respect to the lower stretching member, to adjust the spacing dimension between the stretching members. Accordingly, the tensile force of the belt member, which defines the striking surface, can be adjusted to, for example, provide an ability to adjust the tensile force to reproduce or simulate the sensation of the tension of an acoustic percussion instrument that conforms to the preference of the performer.

Previously, the tension of typical conventional circular heads has been adjusted by adjusting the clamping force of a plurality of tension bolts that are arranged on the peripheral edge of the head and impart tensile force in the radial direction of the head. With such configurations, it can be difficult to adjust the clamping force of the plurality of tension bolts and uniformly adjust the tensile force in the radial direction of the head. In contrast, in a percussion instrument according to the above-described example embodiment, the tensile force of the belt member which forms the striking surface may be adjusted by moving one or both of the stretching members along the long direction of the belt member. Accordingly, an operation to adjust the tension of the striking surface can be simplified relative to typical conventional heads.

In addition, in the event that the tension of the belt member reduces over time due to use, it is possible to restore the desired tension of the belt member by moving one stretching member in a direction to further separate the one stretching member from the other. Accordingly, the service life of the belt member can be extended.

In a further example of a percussion instrument according to any of the above embodiments of the present invention, the belt member is formed in an endless loop shape, and the pair of stretching members are arranged at positions on the inner side of the endless loop form to stretch the loop form. Therefore, the dimension of the belt member in the long direction may be set to a dimension that corresponds to the dimension of separation of the stretching members or greater. When the belt member is struck, it is possible to distribute the tensile force in the entire circumferential direction of the belt member loop. Therefore, the tension of an acoustic percussion instrument that has a head with a relatively larger diameter can be reproduced or simulated, while, at the same time, the percussion instrument can have a downsized design, relative to typical conventional percussion instruments. Accordingly, the tension of a typical conventional acoustic percussion instrument that has a head with a relatively large diameter can be reproduced or simulated, while employing a relatively small set-up space to set up the percussion instrument for use.

In a further example of a percussion instrument according to the above embodiment of the present invention, at least one of the pair of stretching members is supported pivotally on the frame, for rotational movement relative to the frame. Therefore, when the belt member is struck and the tensile force acts, the entire belt member may be more easily pulled toward the area that has been struck, due to the rotation of one or both of the stretching members. Therefore, tensile deformation of the entire belt member is produced relatively smoothly, and it is possible for the entire circumferential direction of the belt member loop to be effectively utilized.

In a further example of a percussion instrument according to some of the above embodiments of the present invention, the belt member has two ends in the long direction, where each end is fixed to the same one of the pair of stretching members, while the other stretching member is positioned on the inner peripheral side of the belt member, at a location along the long dimension of the belt member, between the two ends of the belt member, such that belt member is stretched between the pair of stretching members. Therefore, the dimension of the belt member in the long direction may be set to a dimension that corresponds to the dimension that is greater than the separation of the stretching members. When the belt member is struck, it is possible to distribute the tensile force in the entire lengthwise direction of the belt member. Therefore, the tension of an acoustic percussion instrument that has a head with a relatively larger diameter can be reproduced or simulated, while, at the same time, the percussion instrument can have a downsized design, relative to typical conventional percussion instruments. Accordingly, the tension of a typical conventional acoustic percussion instrument that has a head with a relatively large diameter can be reproduced or simulated, while employing a relatively small set-up space to set up the percussion instrument for use.

In the above embodiment, because there is no need to join the two ends of the belt in the long direction, the component and manufacturing cost of the belt member can be reduced, as compared to the case in which the belt is formed in an endless loop shape.

In a further example of a percussion instrument according to the above embodiment of the present invention, the second one of the pair of stretching members is pivotally supported on the frame for rotational motion relative to the frame. Therefore, when the belt member is struck and the tensile force acts, the second one of the stretching member rotates, the entire belt member may be more easily pulled toward the area that has been struck. Therefore, tensile deformation of the entire belt member is produced relatively smoothly, and it is possible for the entire circumferential direction of the belt member loop to be effectively utilized.

In a further example of a percussion instrument according to any of the above embodiments of the present invention, the percussion instrument is provided with a contact buffering member that is configured from an elastic material and has a second side that is in contact with a second side of the belt member. Therefore, vibrations of the belt member that are produced when the belt member has been struck may be quickly attenuated by the buffering member. Accordingly, acoustic noise that is produced at the time that the belt member has been struck can be suppressed. In a further example embodiment, the percussion instrument has a holding member attached to the frame, and that holds the contact buffering member. Therefore, the movement of the contact buffering member with respect to the frame can be regulated. Accordingly, the force of the impact at the time that the belt member is struck can be readily dampened by the contact buffering member that is in contact with the belt member.

In addition, due to the rapid attenuation of the vibrations of the belt member, it is possible to prevent vibrations of the belt member that would, otherwise continue after the belt member has been struck and, thus, prevent detection by the sensor of such vibrations.

In a further example of a percussion instrument according to embodiments that include a linking buffering member as described above, because vibrations of the belt member that are produced when the belt member is struck are quickly attenuated by the buffering member, acoustic noise that is produced at the time that the belt member has been struck can be suppressed. In addition, the linking buffering member may be arranged to link to mutually facing sides of the inner peripheral surfaces of the belt member. In such embodiments, the construction of the frame can be simplified and reduced in cost by not including the linking buffering member on the frame.

In a further example of a percussion instrument according to any of the above embodiments of the present invention, the percussion instrument is provided with a sensor that detects the striking of the belt member. The sensor is configured to detect the tension or vibration state of the belt member and to provide a signal based on the result of the detection by the sensor that can be utilized to provide an output, via a jack, to an output device. A cable can electrically connect the percussion instrument to another device. For example, the sensor detection signal can be output to an amplifying device that amplifies the detection signal of the sensor or a sound source device that produces a musical tone based on the detection signal of the sensor, and the like.

In embodiments in which the belt member is held at two locations by a pair of stretching members that are positioned at a specified spacing along the long direction of the belt member, a generally linear deformation of the belt member at the time the belt member is struck is likely, as compared to deformations of a typical conventional circular head that is held around the entire peripheral edge. Accordingly, detection of a displacement of the belt member by the sensor can be made relatively accurately, due to the linear deformation of the belt member.

In a further example of a percussion instrument according to any of the above embodiments of the present invention, the belt member of the percussion instrument comprises first and second belt members that are aligned adjacent each other in the width direction of the percussion instrument. Accordingly, the space needed to set up a percussion instrument having two striking surfaces can be relatively small.

BRIEF DESCRIPTION OF THE DRAWINGS

FIG. 2(*b*) is a rear view of the electronic percussion instrument of FIG. 1.

FIG. 2(*c*) is a cross section view of the electronic percussion instrument along the line IIc-IIc of FIG. 2(*b*).

FIG. 3(*b*) is another cross section view of the electronic percussion instrument of FIG. 1, along the line III-III of FIG. 2(*b*).

FIG. 4 (*b*) is a cross section view of the electronic percussion instrument of FIG. 4(*a*), along the line IVb-IVb of FIG. 4(*a*).

FIG. 5(*b*) is another cross section view of the electronic percussion instrument of FIG. 4(*a*), along the line Va-Va of FIG. 4(*a*).

DETAILED DESCRIPTION OF THE PREFERRED EMBODIMENTS

Figure 1:
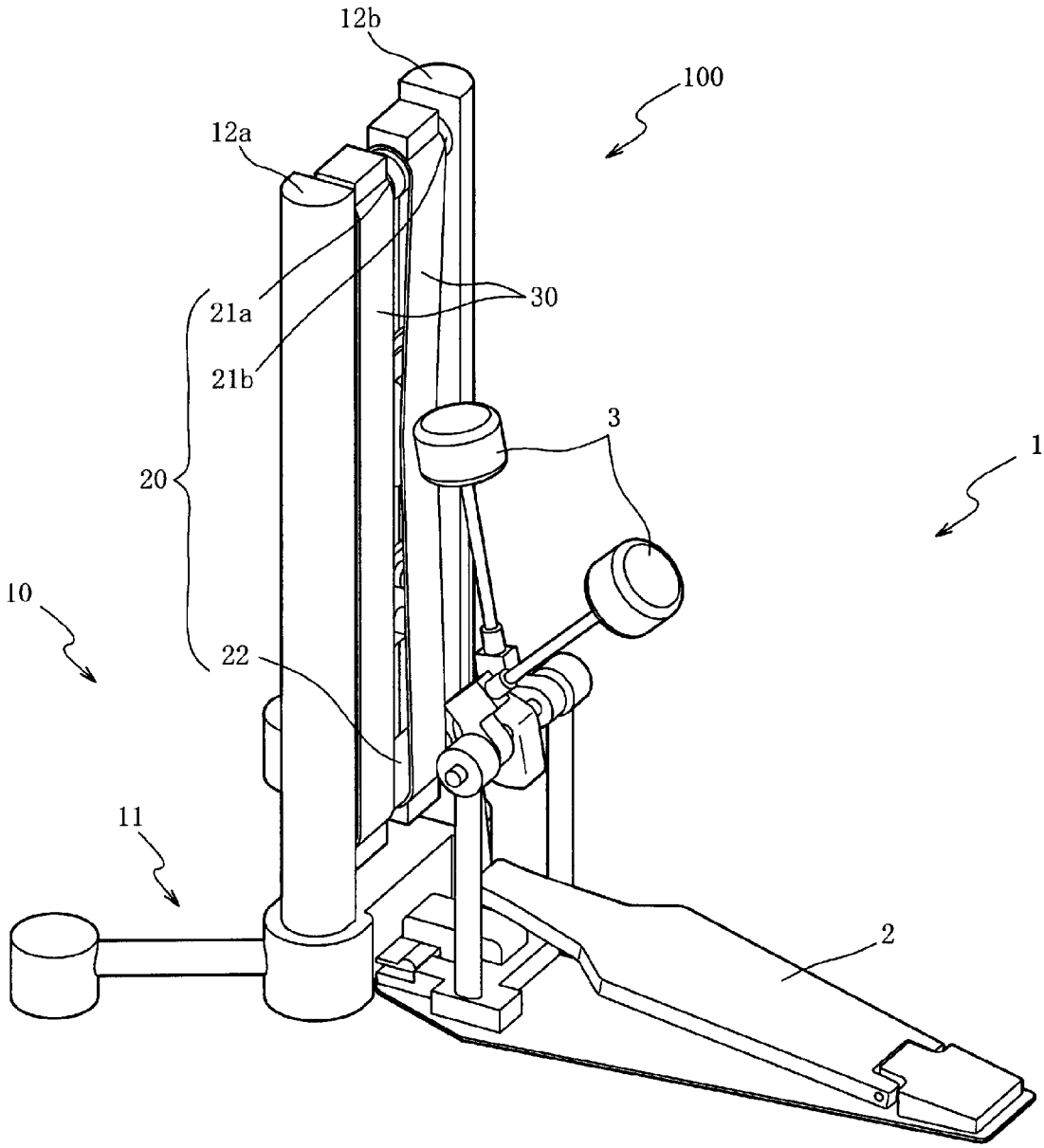
FIG. 1 is perspective view of an electronic percussion instrument according to an embodiment of the present invention.
Figure 2:
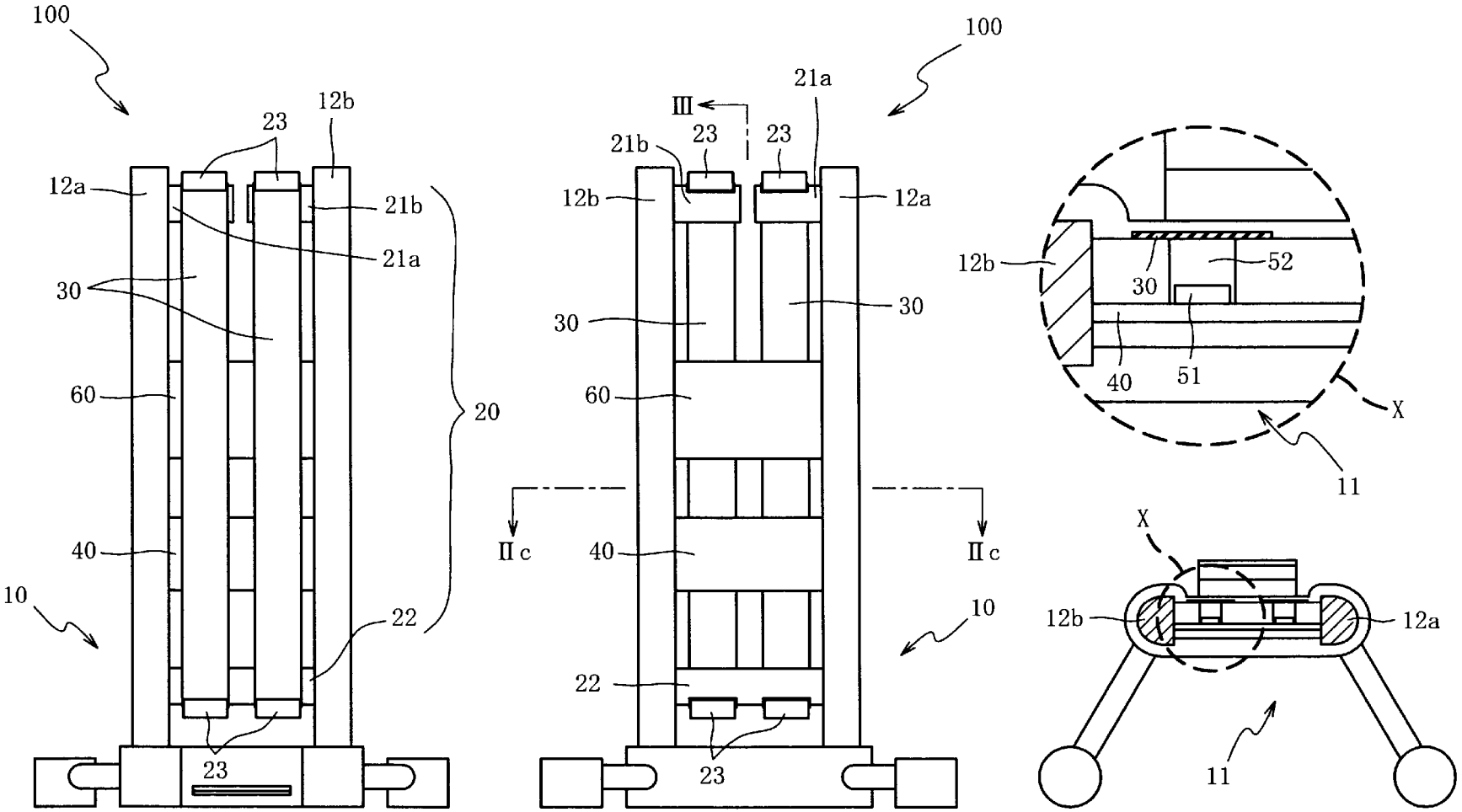
FIG. 2(*a*) is a front view of the electronic percussion instrument of FIG. 1.
Figure 3A:
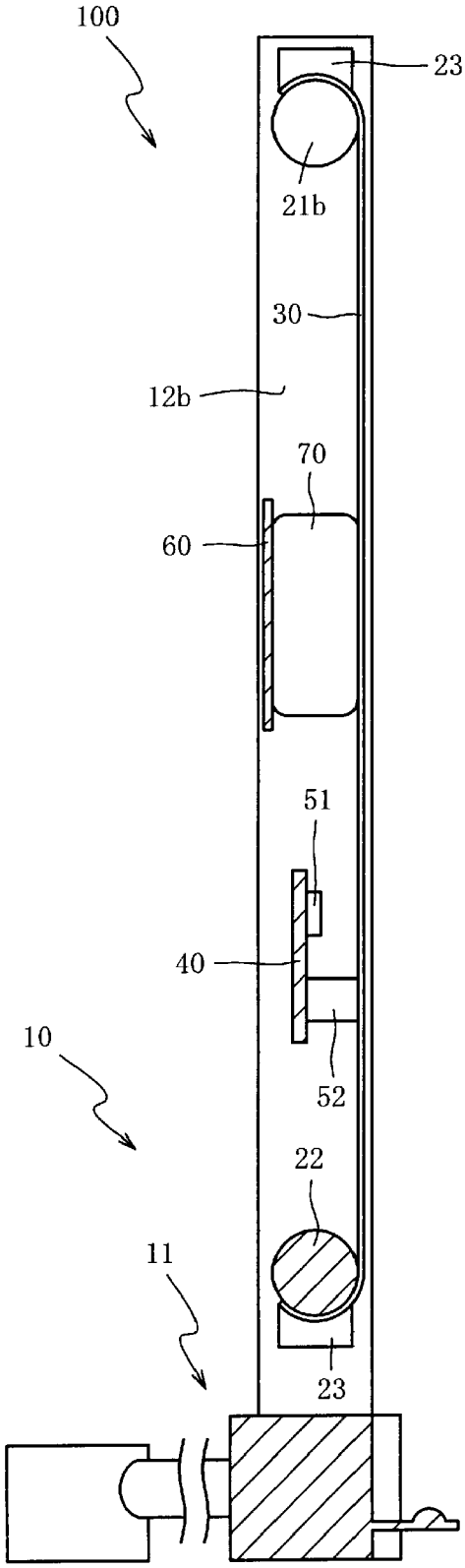
FIG. 3(*a*) is a cross section view of the electronic percussion instrument of FIG. 1, along the line III-III of FIG. 2(*b*).
Figure 3B:
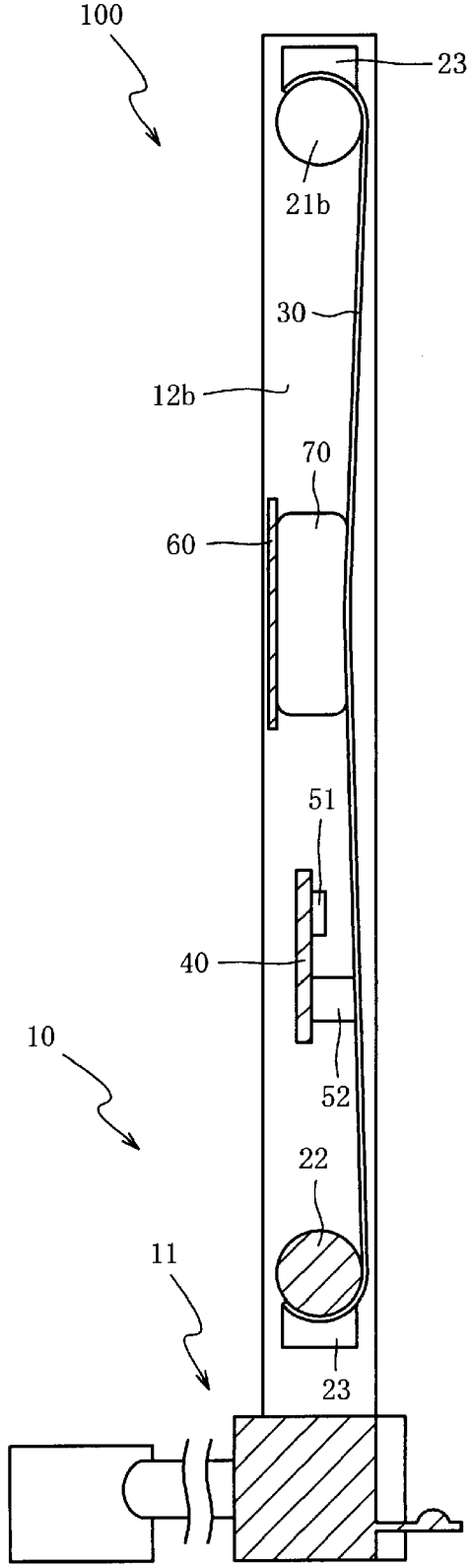

An explanation will be given below regarding preferred embodiments of the present invention while referring to the attached drawings. First, an explanation will be given regarding the configuration of an electronic percussion instrument 100 of FIG. 1, in according to a first embodiment. FIG. 2(*a*) is a front view of the electronic percussion instrument 100. FIG. 2(*b*) is a rear view of the electronic percussion instrument 100. FIG. 2(*c*) is a cross section view of the electronic percussion instrument 100 along the line IIc-IIc of FIG. 2(*b*). FIG. 3(*a*) is a cross section view of the electronic percussion instrument 100 along the line III-III of FIG. 2(*b*). FIG. 3(*b*) is a cross section view of the electronic percussion instrument 100 along the line III-III of FIG. 2(*b*) at the time at which the belt member 30 is struck. In FIG. 1, the foot pedal apparatus 1 is shown in a state in which it has been mounted on the electronic percussion instrument 100. For simplifying the drawing of FIG. 1, a spring (or other bias member) for returning the foot board 2 to its original position after having been stepped on has been omitted from the drawing.

The electronic percussion instrument 100 in FIG. 1 is an electronic bass drum that is performed by striking a striking surface. The electronic percussion instrument 100 includes a frame 10, a pair of stretching members 20 that are supported on the frame 10, and a belt member 30 that is stretched by the pair of stretching members 20. In addition, a first holding member 40 is fastened to the frame 10, and a displacement sensor 51 is held by the first holding member 40. The displacement sensor 51 is configured to detect the amount of displacement in the direction of the thickness (the up and down direction in FIG. 2(*c*)) of the belt member 30 when the striking surface is struck. A piezoelectric sensor 52 is also held by the first holding member 40, and is configured to detect the force of a strike on the belt member 30 when the striking surface is struck. A second holding member 60 is fastened to the frame 10, above the first holding member 40. A buffering member 70 is held by the second holding member 60.

The foot pedal apparatus 1 is a twin pedal type of device. The foot pedal apparatus 1 has two foot boards 2 that are configured to be stepped on by the foot of a performer. The foot pedal apparatus 1 also has two independent beaters 3 that are operatively connected to the foot boards 2, to rotate in conformance with a stepping action on the foot boards 2. In FIG. 1, the foot board 2 for rotationally moving the near side beater 3 in FIG. 1 and the mechanism that links the beaters 3 and the foot boards 2 in FIG. 1, for rotationally moving that beaters 3, have been omitted from the drawing. Suitable linkage mechanisms are known in the art.

The performer causes the beater 3 to move rotationally by stepping on the foot board 2 of the foot pedal apparatus 1. When the belt member 30 is struck by the beater 3, the belt member 30 is made to vibrate. The changes in the state of the belt member 30 due to the vibrations of the belt member 30 are detected by the displacement sensor 51 and the piezoelectric sensor 52. Resulting detection signals produced by the displacement sensor 51 and the piezoelectric sensor 52 are output to a jack (not shown in the drawing). The jack is mounted on the electronic percussion instrument 100 and is electrically connected to the displacement sensor 51 and the piezoelectric sensor 52. The detection signals may be output to a sound source device (not shown in the drawing) via a connecting cable that is connectable and disconnectable from the jack. Accordingly, the sound source device can produce a musical tone based on the detection signals detected by the displacement sensor 51 and the piezoelectric sensor 52.

As is shown in FIG. 2(*a*) and FIG. 2(*b*), the frame 10 has a platform section 11 that is configured to be placed on the floor or other horizontal surface. The frame also includes a first support section 12*a* and a second support section 12*b* that are disposed upright and generally vertical from the platform section 11. The first support section 12*a* and the second support section 12*b* have rod-like shapes that have the same height and are arranged adjacent each other, in parallel, but spaced apart by a specified spacing.

The stretching members 20 apply a tensile force to the belt member 30. The stretching members 20 include a first upper stretching member 21*a* that is supported on the upper end portion (the top portion in FIG. 2(*b*)) of the first support member 12*a*. A second upper stretching member 21*b* is supported on the upper end portion (the top portion in FIG. 2(*b*)) of the second support member 12*b*. A lower stretching member 22 is supported on the lower end portions (the bottom portions in FIG. 2(*b*)) of the first support section 12*a* and the second support section 12*b*. The first upper stretching member 21*a* is composed of a round rod-shaped member that protrudes toward the second support section 12*b* from the first support section 12*a*. The second upper stretching member 21*b* is composed of a round rod-shaped member that protrudes toward the first support section 12*a* from the second support section 12*b*. The lower stretching member 22 is composed of a round rod-shaped member that links the first support section 12*a* and the second support section 12*b*. In addition, the lower stretching member 22 is arranged in parallel with the first upper stretching member 21*a* and the second upper stretching member 21*b*. Moreover, the first upper stretching member 21*a*, the second upper stretching member 21*b* and the lower stretching member 22 are provided with fastening members 23 that are attached to the outer peripheral surfaces of the stretching members.

The belt member 30 has one side (the side facing out of the pager in FIG. 2(*a*)) that is configured as the striking surface. In an example embodiment, the belt member 30 is formed in a band shape from any suitable material, for example, but not limited to, rubber in which glass fibers have been embedded as a core for strengthening the belt member 30. According to an example embodiment, two belt members 30 are arranged in alignment, adjacent each other in the width direction of the belts. Each belt member 30 is pulled and subjected to elastic deformation in the long direction (the up and down direction in FIG. 2(*a*)). Each belt member 30 is fastened on one end in the long direction (the top in FIG. 2(*a*)) by a fastening member 23, to the first upper stretching member 21*a* or the second upper stretching member 21*b*. In addition, each belt member 30 is fastened on the other end in the long direction (the bottom in FIG. 2(*a*)) by the fastening member 23 to the lower stretching member 22. Accordingly, the belt member is mounted (stretched) between the first upper stretching member 21*a* or the second upper stretching member 21*b* and the lower stretching member 22*a* such that a tensile force is applied in the long direction of the belt member 30.

In this manner, the belt member 30, which defines the striking surface, is stretched between the first upper stretching member 21*a* or the second upper stretching member 21*b* and the lower stretching member 22. Because of the elasticity of the belt member 30, the striking surface of the belt member sinks and rebounds when struck, such that a tension sensation that simulates that of an acoustic percussion instrument is produced. In addition, by forming the belt member 30 in a band shape, the dimension of the striking surface in the width direction (the left to right direction in FIG. 2(*a*)) can be made small as compared to the case in which the striking surface is configured in a circular shape. Accordingly, the dimensions of the entire electronic percussion instrument 100 can be minimized, such that the space used to set up the electronic percussion instrument 100 can be minimized.

In those cases where two striking surfaces that produce two different musical tones are desired, previous conventional solutions included setting up two electronic percussion instruments, each having its own head. Because such previous conventional heads typically were shaped, generally circular when viewed from the front, the space needed to set up multiple electronic percussion instruments was relatively large. In addition, with such conventional percussion instruments, a twin pedal type of foot pedal apparatus 1 that has two beaters arranged adjacent to each other could not have ordinarily been operated to strike two independent striking surfaces to produce two different musical tones. In contrast, the electronic percussion instrument 100 has two belt members 30, each of which provide a striking surface. The two belt members 30 are arranged in generally parallel alignment, adjacent each other in the width direction of the belts. Therefore, the space needed to set up the electronic percussion instrument 100 that provides two striking surfaces can be relatively small. In addition, the twin pedal type of foot pedal apparatus 1 can be used to selectively and independently strike any one or strike both of two striking surfaces to produce at least two different musical tones.

As is shown in FIG. 2(*b*) and FIG. 2(*c*), the first holding member 40 supports and arranges the displacement sensor 51 and the piezoelectric sensor 52 in a location where the detection of the displacement of the belt member 30 is possible. In an example embodiment, the first holding member 40 is formed as a plate having a roughly rectangular shape when viewed from the front. One side in the long direction of the first holding member 40 (the right side in FIG. 2(*b*)) is attached to the first support section 12*a*. The other side in the long direction of the first holding member 40 (the left side in FIG. 2(*b*)) is attached to the second support section 12*b*.

The displacement sensor 31 may be any suitable sensor for detecting displacement of a belt member 30, including, but not limited to a reflective type of optical sensor that detects the distance to the belt member 30 by emitting a light from a light emitting element for reflection by the belt member 30, where the reflected light is received by a light receiving element. The displacement sensor 51 is arranged in a location in which the light emitting element and the light receiving element face toward the center or a central portion of the belt member 30, in the width direction (the left to right direction in FIG. 2(*c*)) of the belt member 30. Accordingly, when light from the light emitting element is emitted, the light is reflected from the center or central portion of the belt 30 and is received by the light receiving element.

The piezoelectric sensor 52 is configured to detect a striking force on the belt member 30. The piezoelectric sensor 52 is in operative contact with the side opposite the striking surface side of the belt member 30 (the bottom in FIG. 2(*c*)) via a cushion member that is configured from an elastic material.

The second holding member 60 supports and arranges the buffering member 70 in a position that corresponds to the area in which the belt member 30 is struck by the beater 3. The second holding member 60 is formed in a roughly rectangular plate shape when viewed from the front. One side of the second holding member 60 in the long direction (the right side in FIG. 2(*b*)) is attached to the first support member 12*a* and the other side of the second holding member 60 (the left side in FIG. 2(*b*)) is attached to the second support member 12*b*.

As is shown in FIG. 3(*a*), the buffering member 70 is configured to readily attenuate vibrations of the belt member 30. The buffering member 70 is composed of a compressible, sponge-like material having a roughly rectangular block form. The buffering member 70 is arranged to be in an uncompressed state before the belt member 30 is struck. The buffering member 70 has one side (the left side in FIG. 3(*a*)) attached to the second holding member 60 and a second side (the right side in FIG. 3(*a*)) arranged in contact with the second side of the belt member 30. The buffering member 70 is in contact with the belt member 30 on the back side of the area of the belt member 30 that is struck by the beater 3 (refer to FIG. 1).

With reference to FIG. 3(*b*), during performance of the electronic percussion instrument 100, the belt member 30 changes in the state and the state changes are detected. As is shown in FIG. 3(*b*), when the striking surface of the belt member 30 is struck by the beater 3 (refer to FIG. 1), the belt member 30 is displaced by the striking force in the direction (the left side in FIG. 3(*b*)) toward the displacement sensor 51. The amount of the displacement of the belt member 30 is detected by the displacement sensor 51. Accordingly, in the event that, after detection by the displacement sensor 51 that the belt member 30 has moved toward the displacement sensor 51, the displacement sensor 51 then detects that the belt member 30 has immediately moved away from or separated from the displacement sensor 51, a determination may be made that the performer is using an open performance method. The open performance method is a performance method in which the beater 3 is immediately separated from the striking surface after the striking surface has been struck by the beater 3. In addition, in the event that, after detection by the displacement sensor 51 that the belt member 30 has moved toward the displacement sensor 51, the displacement sensor 51 then does not detect within a specified time period that the belt member 30 has separated from the displacement sensor 51, a determination can be made that the performer is using a closed performance method. The closed performance method is a performance method in which the striking surface continues to be pressed by the beater 3 for a longer period of time after having been struck by the beater 3. Accordingly, the amount of displacement of the belt member 30 may be detected and, in addition, the effect of an open performance method or a closed performance method can be reflected in a musical tone that is produced, based on the detection signal.

The belt member 30 is held at two locations by the pair of stretching members 20. Therefore, compared to typical conventional circular shaped heads that are held over the entire peripheral edge, it is possible for the belt member 30 to be made to deform linearly, in a predictable manner, when the belt is struck. Therefore, the displacement of the belt member 30 can be detected with relatively good accuracy by the displacement sensor 51.

Furthermore, since the light from the light emitting element of the displacement sensor 51 is emitted toward the center or central portion, in the width direction of the belt element 30, the displacement sensor 51 can detect the amount of displacement of the center or central portion of the belt member 30. Because the belt member 30 is not fixed or held on the sides in the width direction of the belt member 30, there can be a tendency for the belt member 30 to twist upon being struck by the beater 3, such that the belt member 30 inclines to one side or the other side in the width direction of the belt member 30 as it is being displaced. However, because the displacement sensor 51 detects the displacement of the center or central portion of the belt member 30, in the direction of the width of the belt member 30, the effect of the twisting of the belt member 30 on the displacement detection can be made relatively small. Accordingly, the detection of the displacement of the belt member 30 by the displacement sensor 51 can be relatively accurate.

The belt member 30 is supported to vibrate, when the striking surface of the belt member 30 is struck by the beater 3 (refer to FIG. 1). The striking force is detected by the piezoelectric sensor 52 from the vibrations of the belt member 30 at the time that the belt member 30 is struck. Accordingly, the strength of the striking force when the belt member 30 has been struck by the beater 3 can be reflected in a musical tone that is produced, for example, from a musical tone producing device, based on the detection signal that the piezoelectric sensor 52 provides.

In addition, because the buffering member 70 is in contact with the belt member 30 on the rear side of belt member 30, at the area of the belt member 30 that is struck, the buffer member 70 can quickly attenuate vibrations of the belt member 30, when the belt member 30 is struck. Therefore, acoustic noise that is produced when the belt member 30 is struck can be suppressed. One side of the buffering member 70 is attached to the second holding member 60, and the other side of the buffering member 70 is arranged in contact with the belt member 30. Therefore, the buffering member 70 is able to control the relative movement of the belt member 30 with respect to the frame, when the belt member 30 is struck by the beater 3. In addition, the striking force imparted at the time that the belt member 30 is struck is readily buffered by the buffering member 70. Furthermore, because vibrations of the belt member 30 are quickly attenuated, it is possible to prevent the belt member 30 from continuing to vibrate after having been struck and, thus, prevent erroneous detections of such vibrations by the piezoelectric sensor 52 as being further strikes.

The electronic percussion instrument 100 has two band-shaped belt members 30 that provide the striking surfaces and that are arranged in parallel alignment and adjacent to each other in the width direction of the belt members 30. Therefore, using two beaters 3 for the foot pedal apparatus 1 (refer to FIG. 1), it is possible to strike two belt members 30, independently or together. Previous twin pedal type foot pedal devices had been used to easily, continually strike one head within a small time interval. However, with the electronic percussion instrument 100 according to embodiments of the present invention, it is possible to strike two striking surfaces with which two different musical tones are produced, using the two beaters 3 of the foot pedal 1.

Figure 4A:
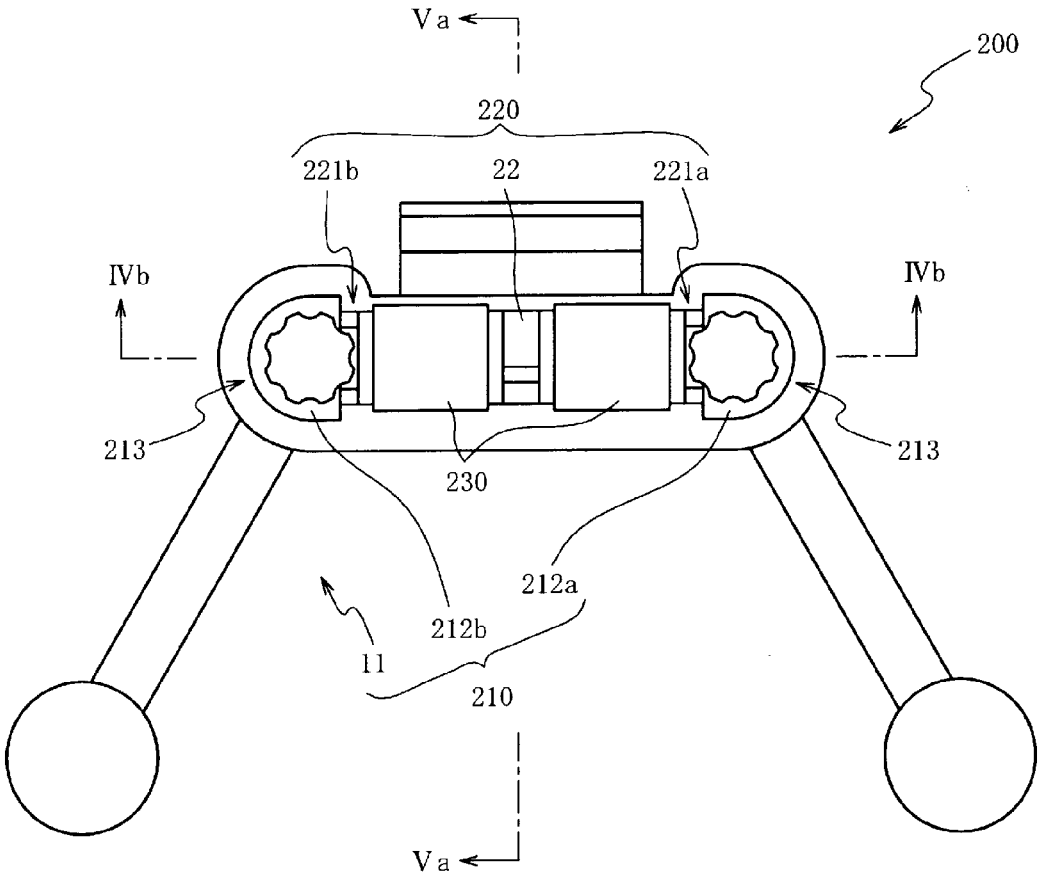
FIG. 4(*a*) is an top view of an electronic percussion instrument according to a further embodiment.
Figure 4B:
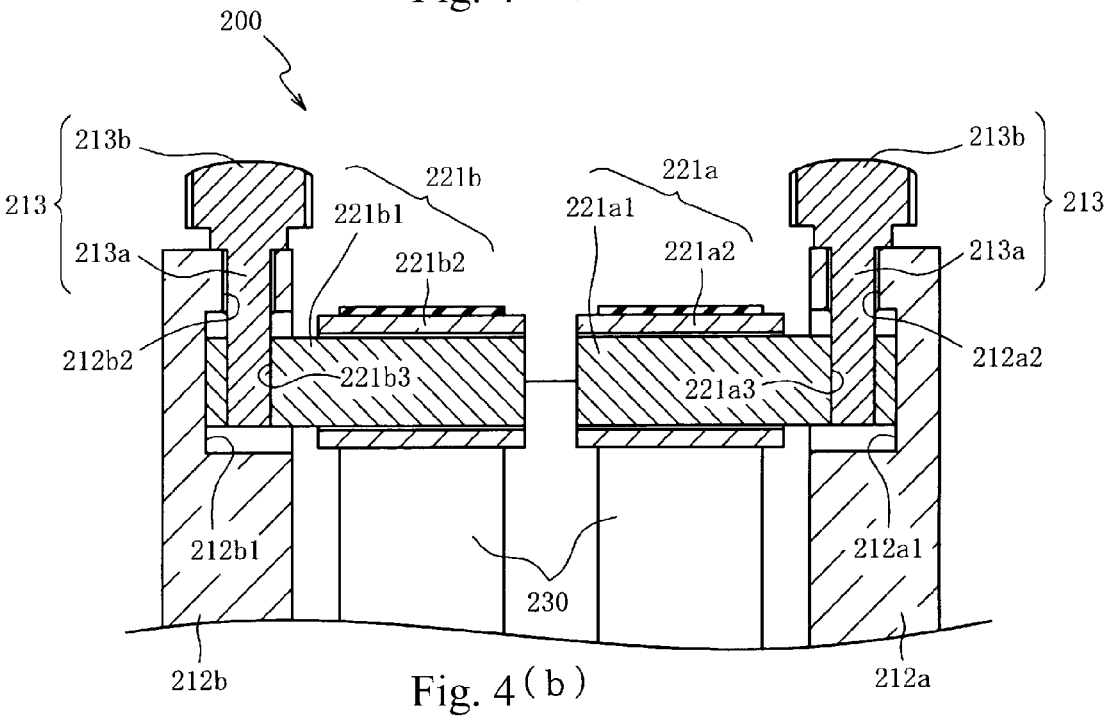
Figure 5:
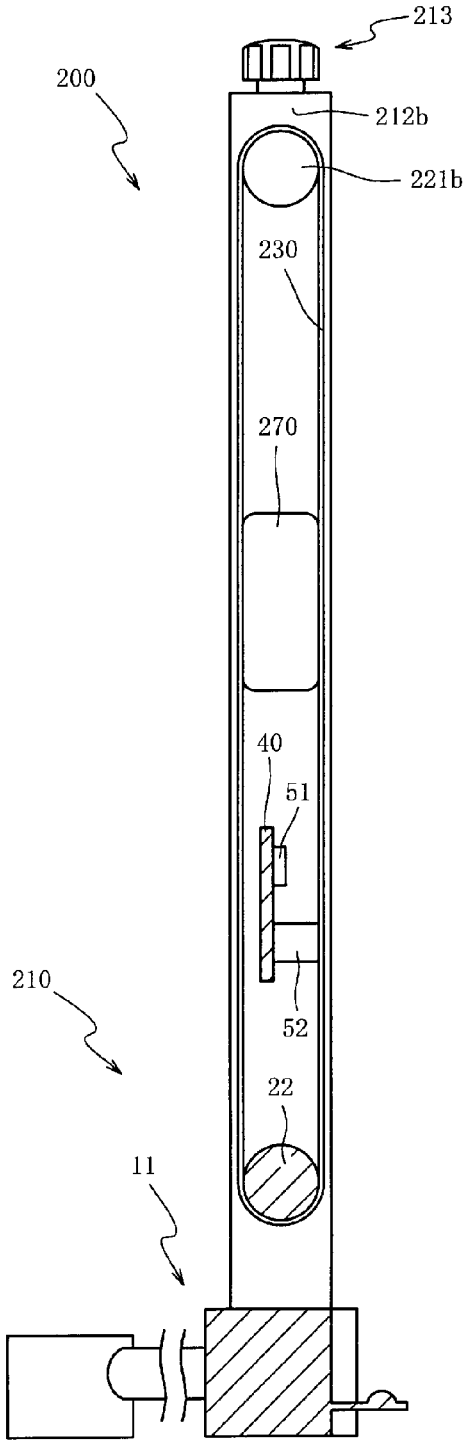
FIG. 5(*a*) is a cross section view of the electronic percussion instrument of FIG. 4(*a*), along the line Va-Va of FIG. 4(*a*).
Figure 5B:
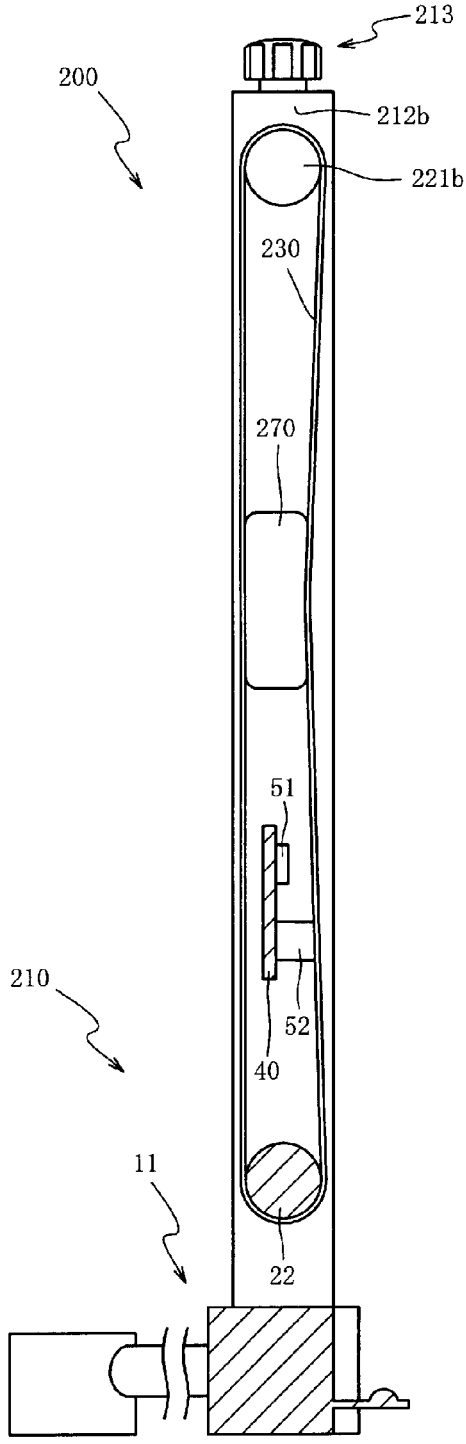

An electronic percussion instrument 200 according to a further embodiment of the present invention is described with reference to FIG. 4*a* through FIG. 5*b*. In embodiments described above, one end of each belt member 30 is attached to one stretching member 20 and a second end of each belt member 20 is attached to a second stretching member 20. In contrast, in the embodiment of FIGS. 4 and 5, the belt member 230 is formed in an endless loop shape and the inner side of the endless loop is supported by the pair of stretching members 220. FIG. 4(*a*) is a top view of the electronic percussion instrument 200. FIG. 4(*b*) is a cross section view of the electronic percussion instrument 200 along the line IVb-IVb of FIG. 4(*a*). FIG. 5(*a*) is a cross section view of the electronic percussion instrument 200 along the line Va-Va of FIG. 4(*a*). FIG. 5(*b*) is a cross section view of the electronic percussion instrument 200 along the line Va-Va of FIG. 4(*a*), in a state at the time that the belt member 230 is struck. Parts having the same reference character as parts described above with respect to the above embodiments are the same or similar to those described above and their descriptions are incorporated herein by reference.

As is shown in FIG. 4 and FIG. 5, the electronic percussion instrument 200 has a frame 210, two stretching members 220 that are supported on the frame 210, belt members 230 that are stretched by the stretching members 220, the first holding member 40, the displacement sensor 51, the piezoelectric sensor 52, and a buffering member 270 that links the mutually facing, inner peripheral surfaces of the belt member 230 to each other.

The frame 210 has the platform section 11. A first support member 212*a* and a second support member 212*b* are arranged upright and extend vertically upward from the platform section 11. The first support member 212*a* and the second support member 212*b* are formed in a rod shape body, each having the same height as the other, and are arranged in parallel and adjacent each other, but separated from each other by a specified spacing.

The first support member 212*a* has a groove-shaped first depression section 212*a*1 and a first insertion passage 212*a*2. The first depression section 212*a*1 forms a depression in the side of the first support member 212*a* that faces the second support member 212*b* and extends along the long direction of the first support member 212*a*. The first insertion passage 212*a*2 is formed through the first support member 212*a*, from the first depression section 212*a*1 toward the upper end surface of the first support member 212*a* (the top surface in FIG. 4*b*). The second support member 212*b* has a groove-shaped second depression section 212*b*1 and a second insertion passage 212*b*2. The second depression section 212*b*1 forms a depression in the side of the second support member 212*b* that faces the first support member 212*a* and extends along the long direction of the second support member 212*b*. The second insertion passage 212*b*2 is formed through the second support member 212*b*, from the second depression section 212*b*1 toward the upper end surface of the second support member 212*b* (the top surface in FIG. 4*b*).

Bolt members 213 are provided for securing the first upper stretching member 221*a* and the second upper stretching member 221*b* to the first and second support members 212*a* and 212*b*, respectively. The bolt member 213 has a shaft-shaped shaft section 213*a* and a head section 213*b*. The shaft section 213*a* is incised with male threads on the outer peripheral surface. The head section 213*b* is fixed at one end of the shaft section 213*a* and has a configuration that has a larger outer diameter than that of the shaft section 213*a*.

The inside diameters of the passages through the first insertion passage 212*a*2 of the first support member 212*a* and through the second insertion passage 212*b*2 of the second support member 212*b* are formed larger than the outside diameters of the shaft sections 213*a* of the bolt members 213, but are formed smaller than the outer diameter of the head sections 213*b* of the bolt members 213. Accordingly, when the shaft section 213*a* of the bolt member 213 has been inserted through the first insertion passage 212*a*2 or the second insertion passage 212*b*2, the head section 213*b* is retained by the upper end surface of the first support member 212*a* or the second support member 212*b*.

The stretching member 220 is configured to apply a tensile force to the belt member 230. The stretching member 220 includes a first upper stretching member 221*a*, a second upper stretching member 221*b* and a lower stretching member 22. The first upper stretching member 221*a* is supported on the upper end (the top in FIG. 4(*b*)) of the first support member 212*a*. The second upper stretching member 221*b* is supported on the upper end (the top in FIG. 4(*b*)) of the second support member 212*b*.

The first upper stretching member 221*a* is arranged to protrude toward the second support member 212*b* from the first support member 212*a*. The first upper stretching member 221*a* includes a cylindrical first pivot support member 221*a*1 and a drum-shaped first roller member 221*a*2. One end of the first pivot support member 221*a*1 (the right side in FIG. 4(*b*)) is inserted into the first depression section 212*a*1 of the first support member 212*a*. The first roller member 221*a*2 is fitted to the other end of the first pivot support member 221*a*1 (the left side in FIG. 4(*b*)).

The first pivot support member 221*a*1 is a round rod-shaped member for adjusting the tension of the belt member 230. The first pivot support member 221*a*1 has a first pass-through hole 221*a*3 that passes through the outer peripheral surface of one end of the first pivot support member 221*a*1

(the right end in FIG. 4(*b*)). The first pass-through hole 221*a*3 is formed in a position that corresponds to the first insertion passage 212*a*2 when one end of the first pivot support member 221*a*1 has been inserted into the first depression section 212*a*1 of the first support member 212*a*. Female threads are incised on the inner peripheral surface of the first pass-through hole 221*a*3, for screw-threading engagement with the male threads on the shaft section 213*a* of the bolt member 213.

Therefore, the first pivot support member 221*a*1 is supported by the first support section 212*a*, by the screwing of the shaft section 213*a* of the bolt member 213 through the first pass-through hole 221*a*3 of the first pivot support member 221*a*1 and the passage 212*a*2 that is formed in the upper end of the first support section 212*a*. In addition, the depression section 212*a*1, into which the one end of the first pivot support member 221*a*1 is inserted, extends in the long direction of the first support section 212*a*, and the head section 213*b* of the bolt member 213 is retained by the upper surface of the first support section 212*a*. Therefore, by screwing the shaft section 213*a* of the bolt member 213 through the first pass-through hole 221*a*3, the first pivot support member 221*a*1 is moved toward the upper end of the support section 212*a*. Thus, by adjusting the amount that the bolt 213 is screwed in with respect to the first pivot support member 221*a*1, the first pivot support member 221*a*1 is adjustably shifted toward the upper end or the lower end of the first support section 212*a*. Accordingly, the first upper stretching member 221*a* is supported in a manner such that its position can be shifted on the first support section 212*a* relative to the lower stretching member 22.

The first roller member 221*a*2 is configured to reduce the friction of the belt member 230 with respect to the first upper stretching member 221*a* and is supported on the first pivot support member 221*a* for rotation relative to the first pivot support member 221*a*.

The second upper stretching member 221*b* is arranged to protrude toward the first support member 212*a* from the second support member 212*a*. The second upper stretching member 221*b* includes a cylindrical second pivot support member 221*b*1 and a drum-shaped second roller member 221*b*2. One end of the second pivot support member 221*b*1 (the left side in FIG. 4(*b*)) is inserted into the second depression section 212*b*1 of the second support member 212*b*. The second roller member 221*b*2 is fitted to the other end of the second pivot support member 221*b*1 (the right side in FIG. 4(*b*)). The second pivot support member 221*b*1 has a second pass-through hole 221*b*3 that passes through the outer peripheral surface of one end of the second pivot support member 221*b*1. The second pivot support member 221*b*1, the second roller member 221*b*2, and the second pass-through hole 221*b*3 have the same configuration as the first pivot support member 221*a*1, the first roller member 221*a*2, and the first pass-through hole 221*a*3 respectively.

As is shown in FIG. 5(*a*), the belt members 230 are formed in an endless loop shape and may be made from any suitable material, for example, but not limited to, a rubber material that has glass fibers embedded as a core for strengthening. Two belt members 230 are arranged in parallel alignment and adjacent each other in the width direction of the belt members 230. Each belt member 230 is formed in an elongated loop and is pulled elastically in the long direction of the loop (the up and down direction in FIG. 5(*a*)). The first upper stretching member 221*a*, the second upper stretching member 221*b* and the lower stretching member 22 are arranged adjacent the inner peripheral surface side of the loop of the belt member 230. Each belt member 230 is mounted and stretched between the first upper stretching member 221*a* or the second upper stretching member 221*b* and the lower stretching member 22, in a state in which tensile force is applied in the long direction of the belt member 230.

In addition, the first upper stretching member 221*a* and the second upper stretching member 221*b* are supported on the first support section 212*a* and the second support section 212*b*, respectively, in a manner that allows adjusting movement of the first and second upper stretching members 221*a* and 221*b*, relative to the lower stretching member 22. Therefore, by adjustably shifting the position of the first upper stretching member 221*a* or the second upper stretching member 221*b* with respect to the lower stretching member 22, along the circumferential direction of the belt member 230, the amount of separation between the first upper stretching member 221*a* or the second upper stretching member 221*b* and the lower stretching member 22 can be adjusted. Accordingly, the tension of the belt member 230, which forms the striking surface, can be adjusted to reproduce or simulate the sensation of the tension of an acoustic instrument in conformance with the preferences of the performer.

Because the belt member 230 is formed in an endless loop shape, the dimension in the long direction (the up and down direction in FIG. 5(*a*)) of the belt member 230 can be set as a dimension that is greater than the dimension of the separation between the first upper stretching member 221*a* or the second upper stretching member 221*b* and the lower stretching member 22. In alternative embodiments in which one end in the long direction of the belt member is fastened to the first upper stretching member 221*a* or the second upper stretching member 221*b* and the other end in the long direction is fastened to the lower stretching member 22, the dimension of the belt member, in the long direction of the belt member, is equal to the dimension of the separation between the first upper stretching member 221*a* or the second upper stretching member 221*b* and the lower stretching member 22. In contrast, in embodiments in which the belt member 230 is formed in an endless loop shape, the pair of stretching members 220 are arranged on the inner peripheral surface of the belt member 230. Therefore, it is possible to make the dimension of the separation between the first upper stretching member 221*a* or the second upper stretching member 221*b* and the lower stretching member 22 smaller than the dimension in the circumferential direction of the belt member 230. Accordingly, it is possible to reproduce or simulate the sensation of the tension of an acoustic percussion instrument that has a head with a larger diameter while minimizing the size of the electronic percussion instrument 200 by making the dimension of the height of the electronic percussion instrument 200 relatively small. Therefore, the space required to set up the electronic percussion instrument 200 can be minimized, while reproducing or simulating the sensation of the tension of an acoustic percussion instrument that has a larger head.

Previously, the tension of typical conventional circular heads had been adjusted by adjusting the clamping force of a plurality of tension bolts that are arranged on the peripheral edge of the head and impart tensile force in the radial direction of the head. With such configurations, it can be difficult to adjust the clamping force of the plurality of tension bolts and uniformly adjust the tensile force in the radial direction of the head. In contrast, in a percussion instrument 200 according to the above-described example embodiment, the tensile force of the belt member 230 which forms the striking surface may be adjusted by moving the first upper stretching member 221*a* or the second upper stretching member 221*b* along the long direction of the belt member 230. Accordingly, an operation to adjust the tension of the striking surface can be simplified relative to typical conventional heads.

In addition, in the event that the tension of the belt member 230 reduces over time due to use, it is possible to restore the desired tension of the belt member 230 by moving the first upper stretching member 221*a* or the second upper stretching member 221*b* in a direction to further separate them from the lower stretching member 22. Accordingly, the service life of the belt member 230 can be extended.

The buffering member 270 is configured to readily attenuate vibrations of the belt member 230. The buffering member 270 is composed of a compressible, sponge-like material having a roughly rectangular block form. The buffering member 270 is arranged to be in an uncompressed state before the belt member 230 is struck. The buffering member 270 has one side surface (the left side in FIG. 5(*a*)) and the other side surface (the right side in FIG. 5(*a*)) adhered to the inner peripheral surface of the belt member 230. The buffering member is adhered to the belt member 230 on the back side of the area of the belt member 230 that is struck by the beater 3 (refer to FIG. 1).

Because the buffering member 270 has two side surfaces attached to the inner peripheral surface of the belt member 230, a further member for making contact with the belt member 230 is not needed, as compared to a case in which the buffering member 270 is held by the first support section 212*a* and the second support section 212*b*. Therefore, the structure of the frame 210 can be further simplified and the cost of making the product can be reduced.

During performance of the electronic percussion instrument 200, the belt member 230 changes in the state and the state changes are detected. Because the belt member 230 shown in FIG. 5(*b*) is formed in an endless loop shape, when the belt member 230 is struck, the tensile force from the strike is distributed over the entire circumferential direction of the loop of the belt member 230.

In addition, because the belt member 230 is suspended on the first roller member 221*a*2 or the second roller member 221*b*2, when the belt member 230 is pulled toward the area that has been struck, the first roller member 221*a*2 or the second roller member 221*b*2 that supports the belt member 230 that has been struck is caused to rotate. Because the first roller member 221*a*2 or the second roller member 221*b*2 rotates, the entire belt member 230 is readily pulled toward the area that has been struck. Therefore, the entire belt member 230 is smoothly pulled and deformed, and the entire circumferential dimension of the belt member 230 is used.

Furthermore, because the buffering member 270 is adhered to the belt member 230 on the rear surface directly behind the area of the belt member 230 that is struck, vibrations of the belt member 230 can be quickly attenuated by the buffering member 270. Accordingly, the acoustic noise that is produced when the belt member 230 is struck can be suppressed. Furthermore, because vibrations of the belt member 230 are quickly attenuated, it is possible to prevent the belt member 230 from continuing to vibrate after having been struck and, thus, prevent erroneous detections of such vibrations by the piezoelectric sensor 52 as being further strikes.

An explanation of the present invention has been given above based on example embodiments; but the present invention is in no way limited to the example embodiments described above, but also includes various improvements and modifications that do not deviate from and are within the scope of the purport of the present invention.

For example, in embodiments described above, the detection signals that are provided by the displacement sensor 51 and the piezoelectric sensor 52 are output to a sound source device that produces a musical tone based on the detection signal. However, in other embodiments, the detection signals that are provided by the displacement sensor 51 and the piezoelectric sensor 52 may be output to an amplifying device that amplifies the detection signal.

In addition, while embodiments of the electronic percussion instrument 100 and 200 described above include the displacement sensor 51 and the piezoelectric sensor 52, other embodiments are configured such that the electronic percussion instrument 100 and 200 has only one of the displacement sensor 51 or the piezoelectric sensor 52. By employing only one of the displacement sensor 51 or the piezoelectric sensor 52, the component costs can be reduced.

Furthermore, in embodiments described above, the electronic percussion instrument 100 and 200 are furnished with two belt members 30 and 230. However, in other embodiments, the electronic percussion instrument 100 and 200 may be furnished with one belt member 30 and 230. In yet further embodiments, the dimension in the width direction of the belt member may be sufficiently large so that both of the two beaters 3 of the foot pedal apparatus 1 are arranged to strike the same or single belt member. By employing a single belt member that can be struck by both of the two beaters 3 of the foot pedal apparatus 1, it is possible to easily strike the belt member continually in a short time interval.

In embodiments described above, an optical sensor is used as the displacement sensor 51. However, in other embodiments, other non-contact type of sensors, for example, a sensor that uses ultrasonic waves, magnetic flux and the like, or a contact type of sensor such as a differential transformer and the like may be used as the displacement sensor.

In embodiments described above, the holding member 40 that holds the displacement sensor 51 and the piezoelectric sensor 52 is attached to the first support section or member 12*a* and 212*a* and the second support section or member 12*b* and 212*b*. However, in other embodiments, the first holding member 40 is supported to shift along the long direction of the first support section or member 12*a* and 212*a* and the second support section or member 12*b* and 212*b* relative to the first support section or member 12*a* and 212*a* and the second support section or member 12*b* and 212*b*. Accordingly, the detection level of the displacement sensor 51 and the piezoelectric sensor 52 may be adjusted by adjusting the position of the displacement sensor 51 and the piezoelectric sensor 52 to be closer to, or more separated from, the location that is struck by the beater 3.

In embodiments described above, the belt members 30 and 230 are stretched by the pair of stretching members 20 and 220 such that the long directions of the belt members 30 and 230 coincide with the vertical direction of the electronic percussion instrument 100 and 200 when viewed from the front. However, in other embodiments, the belt members 30 and 230 may be stretched by the stretching members such that the long direction of the belt members 30 and 230 coincide with the horizontal direction or a diagonal direction of the electronic percussion instrument when viewed from the front. Accordingly, the dimension of the height of the electronic percussion instrument can be reduced.

In certain embodiments described above, one end in the long direction of the belt member 30 is fastened by the fastening member 23 to the first upper stretching member 21*a* or the second upper stretching member 21*b*, while the other end in the long direction is fastened by the fastening member 23 to the lower stretching member 22. However, in further embodiments, one end or the other end in the long direction of the belt member 30 may be linked to the first upper stretching member

21*a*, the second upper stretching member 21*b*, or the lower stretching member 22 via a wire or other linkage structure.

In certain embodiments described above, one end in the long direction of the belt member 30 is fastened to the first upper stretching member 21*a* or the second upper stretching member 21*b* and the other end in the long direction is fastened to the lower stretching member 22 such that tensile force is applied to the belt member 30 in the long direction by the pair of stretching members 20. However, in other embodiments, both ends in the long direction of the belt member 30 may also be fixed to one of either the first upper stretching member 21*a* (or the second upper stretching member 21*b*) or the lower stretching member 22. In addition, the other one of the first upper stretching member 21*a* (or the second upper stretching member 21*b*) or the lower stretching member 22 is arranged adjacent the inner peripheral surface between one end and the other end in the long direction of the belt member 30. As a result, the belt member is stretched by the pair of stretching members 20 and the dimension in the long direction of the belt member may be larger than the dimension of the separation from the first upper stretching member 21*a* (or the second upper stretching member 21*b*) to the lower stretching member 22. Accordingly, when the belt member is struck, the tensile force is distributed over the entire belt member in the direction of the length of the belt member. Therefore, it is possible to reproduce or simulate the sensation of the tension of an acoustic percussion instrument that has a head with a relatively large diameter, while employing a relatively small design size for the electronic percussion instrument. Accordingly, the space required to set up the electronic percussion instrument can be relatively small, while reproducing or simulating the sensation of the tension of an acoustic percussion instrument that has a head with a relatively large diameter. In addition, because the process of joining the belt ends is not necessary, as compared to embodiments in which the belt member is formed in an endless loop shape, the component cost of the belt member can be reduced.

In certain embodiments described above, the first upper stretching member 221*a* and the second upper stretching member 221*b* are supported in a manner that allows their positions to be adjusted relative to the first support member 212*a* and the second support member 212*b*. However, in other embodiments, the lower stretching member 22 is supported in a manner that allows its position to be adjusted relative to the first support member 212*a* and the second support member 212*b*. Alternatively or in addition, the first support member 212*a* and the second support member 212*b* may be configured to be selectively expandable.

In certain embodiment described above, the first upper stretching member 221*a* and the second upper stretching member 221*b* are provided with the first pivot support member 221*a*1 and the second pivot support member 221*b*1, and the first roller member 221*a*2 and the second roller member 221*b*2. However, in other embodiments, the lower stretching member may be provided with a similar configuration of a cylindrical pivot support member that is linked to the first support section 212*a* and the second support section 212*b* and a drum-shaped roller member that is fitted to the pivot support member.

In further embodiments, the electronic percussion instrument 100 and 200 may be used to serve an additional purpose as a drum stand, by attaching and supporting mounting members to the frame 10 and 210 of the electronic percussion instrument 100 and 200, where each mounting member is configured to hold at least one snare drum, tom-tom, cymbal or the like. Accordingly, additional space would not be required or may be minimized for arranging the electronic percussion instrument 100 and 200 separately from a further drum stand. Therefore, the space to set up a drum set that includes a snare drum, a tom-tom, cymbal and the like, with the electronic percussion instrument 100 and 200, can be relatively small.

In example embodiments described above, the belt member 30 and 230 is formed in band shape, of any suitable material, including, but not limited to rubber in which glass fibers have been embedded as a core for strengthening. In other embodiments, the belt member 30 may be formed as an elastic body that uses a polymer material such as a woven form or net form material that is configured from polyester fiber or the like. Alternatively, or in addition, the belt member 30 may have an elastic body having a superimposed polymer material.

In embodiments described above, the electronic percussion instrument 100 and 200 are provided with the displacement sensor 51 and the piezoelectric sensor 52. However, further embodiments of a percussion instrument of the present invention may be utilized as a practice percussion instrument, in which case, the displacement sensor 51 and the piezoelectric sensor 52 may be omitted or disabled. In those embodiments in which the displacement sensor 51 and the piezoelectric sensor 52 are omitted, the first holding member 40 for supporting the displacement sensor 51 and piezoelectric sensor 52 may be omitted, as well. Accordingly, in such embodiments, the size and cost of the percussion instrument can be further minimized. In addition, the generation of acoustic noise can be suppressed, as compared to the case in which the striking surface is configured in a conventional circular shape.

What is claimed is:

1. A percussion instrument comprising:

a belt member that is formed in a band shape from an elastic material, the belt member having a lengthwise dimension that is longer than a width dimension, the belt member having a striking surface for receiving a striking force and a second surface that faces opposite the striking surface;

a pair of stretching members separated from each other and arranged in respective positions along the direction of the lengthwise dimension of the belt member, the pair of stretching members arranged to stretch the belt member between the pair of stretching members;

a frame that supports the pair of stretching members; and a connection portion arranged to connect the frame to a foot pedal apparatus that has a beater for striking the striking surface of the belt member when the frame is connected to the foot pedal apparatus.

2. The percussion instrument of claim 1 wherein at least one of the stretching members is supported on the frame for selective movement relative to the other stretching member along the lengthwise dimension of the belt member.

3. The percussion instrument of claim 2, wherein the belt member is formed in an endless loop form and is stretched between the pair of stretching members, where the stretching members are positioned adjacent an inner peripheral surface side of the endless loop form of the belt member.

4. The percussion instrument of claim 3 wherein at least one of the stretching members is pivotally supported on the frame for rotational motion relative to the frame.

5. The percussion instrument of claim 2, wherein the belt member has two ends that are each fixed to a first one of the stretching members from the pair of stretching members, and a second one of the stretching members from the pair of stretching members is arranged adjacent an inner peripheral surface side of the belt member at a location in the lengthwise direction of the belt member between the two ends of the belt member, and wherein the belt member is suspended by the first and second stretching members.

6. The percussion instrument of claim 2, further comprising:

a contact buffering member made from an elastic material, the contact buffering member having one surface that is in contact with the second surface of the belt member; and a holding member that holds the contact buffering member, the holding member being attached to the frame.

7. The percussion instrument of claim 6, further comprising a sensor that is mounted on the frame and configured to detect a striking state of the belt member when the belt member is struck.

8. The percussion instrument of claim 2, further comprising a sensor that is mounted on the frame and configured to detect a striking state of the belt member when the belt member is struck.

9. The percussion instrument of claim 1, wherein the belt member is formed in an endless loop form and is stretched between the pair of stretching members, where the stretching members are positioned adjacent an inner peripheral surface side of the endless loop form of the belt member.

10. The percussion instrument of claim 9, further comprising a linking buffering member made of an elastic material that links two mutually-facing locations on the second surface of the belt member.

11. The percussion instrument of claim 1, wherein the belt member has two ends that are each fixed to a first one of the stretching members from the pair of stretching members, and a second one of the stretching members from the pair of stretching members is arranged adjacent an inner peripheral surface side of the belt member at a location in the lengthwise direction of the belt member between the two ends of the belt member, and wherein the belt member is suspended by the first and second stretching members.

12. The percussion instrument cited in claim 11 characterized in that the second stretching member is pivotally supported on the frame for rotation relative to the frame.

13. The percussion instrument of claim 1, further comprising:

a contact buffering member made from an elastic material has one surface that is in contact with the second surface of the belt member; and a holding member that holds the contact buffering member, the holding member being attached to the frame.

14. The percussion instrument of claim 1, further comprising a sensor that is mounted on the frame and configured to detect a striking state of the belt member when the belt member is struck.

15. The percussion instrument of claim 1, further comprising a second belt member arranged adjacent to the belt member in the width dimension of the belt member.

16. The percussion instrument of claim 1, wherein the frame has a platform section configured to rest on a generally flat surface and wherein the striking surface of the belt member is arranged transverse to the generally flat surface when the platform section rests on the generally flat surface.

17. A percussion instrument comprising:

at least one belt member that is formed of an elastic material having a band shape, the at least one belt member having a lengthwise dimension that is longer than its width dimension, the at least one belt member having a striking surface for receiving a striking force;

a frame that supports at least one first stretching member and a second stretching member that hold the at least one belt member and pull taut or stretch the striking surface of the at least one belt member;

at least one beater provided to selectively strike the striking surface of the at least one belt member.

18. A percussion instrument as recited in claim 17, wherein the at least one belt member comprises a plurality of belt members arranged adjacent each other.

19. A percussion instrument as recited in claim 17, wherein the at least one belt member comprises first and second belt members arranged adjacent each other, and wherein the at least one beater comprises first and second beaters arranged adjacent to each other, each beater configured to selectively and independently strike a respective one of the belt members without striking the other belt member.

20. A percussion instrument as recited in claim 17, wherein the first and second stretching members are arranged to engage and stretch a length of the at least one belt member located between the first and second stretching members, wherein the striking surface of the at least one belt member is on the length of the at least one belt member located between the first and second stretching members.

21. The percussion instrument of claim 17, wherein at least one of the first and second stretching members is supported on the frame for selective movement relative to the other stretching member, for adjusting a tensile force on the at least one belt member.

* * * * *